United States Patent [19]

Treuhaft et al.

[11] 4,440,325

[45] Apr. 3, 1984

[54] ACTUATOR

[76] Inventors: Martin B. Treuhaft, 3434 Fallen Leaf, San Antonio, Tex. 78230; Knut L. Winquist, 326 E. Glenview, San Antonio, Tex. 78201

[21] Appl. No.: 286,479

[22] Filed: Jul. 24, 1981

[51] Int. Cl.[3] ..... B65D 83/14

[52] U.S. Cl. ..... 222/402.14; 222/153

[58] Field of Search ..... 222/402.14, 402.15, 222/402.11, 402.13, 153

[56] References Cited

U.S. PATENT DOCUMENTS

| | | | |
|---|---|---|---|
| 3,325,064 | 6/1967 | Scheck | 222/402.14 |
| 3,424,354 | 1/1969 | Dykinga | 222/402.14 |
| 3,613,960 | 8/1971 | Beard | 222/402.1 X |
| 3,756,472 | 9/1973 | Vos | 222/402.14 X |
| 3,804,302 | 4/1974 | Yamada et al. | 222/402.14 X |
| 4,132,333 | 1/1979 | Debard | 222/402.13 |
| 4,186,853 | 2/1980 | White | 222/402.14 X |
| 4,260,080 | 4/1981 | Gailitis | 222/402.14 |
| 4,277,004 | 7/1981 | Barlics | 222/402.14 |

*Primary Examiner*—Joseph J. Rolla
*Assistant Examiner*—Thomas C. Fitzgerald

[57] ABSTRACT

An actuator having a collar with two annular grooves so that the actuator container be engaged to an aerosol container in two different positions; one, the lower, where the container is kept activated and another, the upper, where the container is kept deactivated. The actuator can easily be manually engaged or disengaged to the container, and likewise, easily be moved into the different positions.

5 Claims, 6 Drawing Figures

ACTUATOR

BACKGROUND OF THE INVENTION

Most often when an aerosol container is used for spraying of, for example, an insecticide, the container is operated simply by pressing down a button on the top of the container. Then a spring loaded valve in the container is opened by the button allowing the insecticide to flow out through an orifice in the button. The flow continues as long as there is a force applied on the button strong enough to overcome the force of the valve spring and is discontinued when this force is released. However, in some cases it is desired that the aerosol container is kept open for a certain period of time, which can be very cumbersome when the button is manually pressed upon by a finger. Also, in some cases it may be dangerous to remain close to the open container and its out flowing medium for a relatively long period of time. The only hitherto known method to overcome this problem is that the container is provided with a device an actuator, by which the button can be locked in the position where the container is activated. This method is suitable, however, only when it is desired that the entire contents of the container be discharged, because there is no easy way to get the button unlocked once it is locked in the position where the container is open. Nor is there an easy way to change such an aforementioned appurtenance in order to eliminate its defect.

SUMMARY OF THE INVENTION

The present invention eliminates the aforementioned deficiency and provides an actuator of very simple design which when applied on an aerosol container, has two stable positions on the container. In one, the upper position, the container is not activated; however, in the other, the lower position, the container is activated. The actuator can easily be moved into either position. An actuator in accordance with this invention has a resiliant collar with two grooves of which either one will fit into the ridge in the collar on the upper part of an aerosol container. The spring force from the collar of the actuator is strong enough to keep the actuator in either position where the container is activated or deactivated, but not so strong that the actuator can not easily be manually pushed or pulled into the desired position. If desired, the actuator can also be easily removed and applied on another container.

DESCRIPTION OF THE DRAWINGS

One embodiment of the invention is shown in

DESCRIPTION OF THE PREFERRED EMBODIMENT

Figure 1:
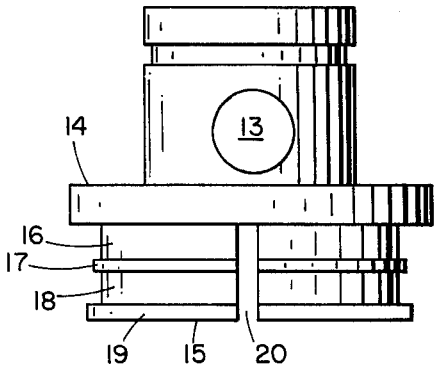
FIG. 1 which is a side elevation of the invention.
Figure 2:
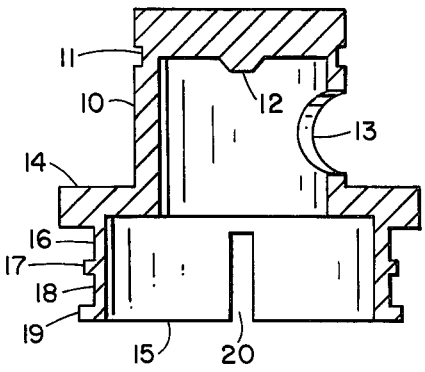
FIG. 2 is a longitudinal cross-section of the embodiment in FIG. 1.

FIG. 1 and FIG. 2 show how an actuator in accordance with the invention can be made in one piece. Its upper cylindrical part, 10, has at its upper end an outside groove, 11, and in the roof of its hollow inside there is a detent, 12. Through the side wall there is a hole, 13. This aforementioned upper cylindrical part has at its lower end a flange, 14, below which there is a collar, 15. The collar has two grooves, an upper, 16, between the flange, 14, and a middle ridge, 17, and a lower, 18, between this ridge, 17, and a bottom ridge 19. The collar also has a number of slots, 20.

Figure 3:
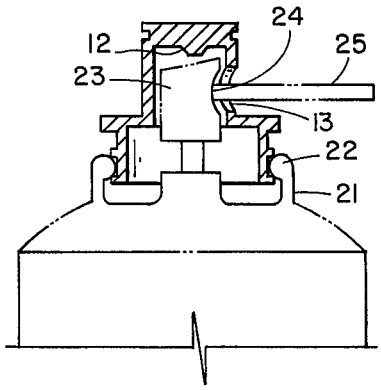
FIG. 3 and FIG. 4 schematically show the application of the same embodiment on a common type of an aerosol in the deactivated and activated modes respectively. Another embodiment of the invention is shown in FIG. 5 which is a longitudinal cross-section of the embodiment. Its side elevation is the same as shown in FIG. 1.
Figure 4:
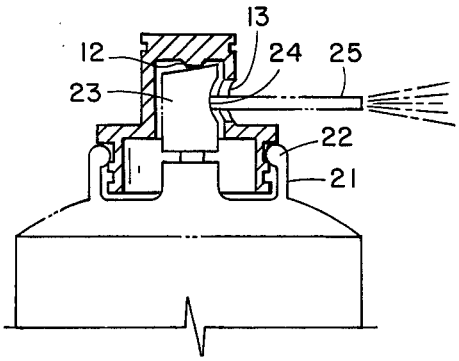

Operation of the actuator is schematically illustrated in FIG. 3 and FIG. 4 which show the actuator applied on an aerosol container, of the most commonly used type, the upper part of the container having a circular collar, 21, in which there is an inside annular ridge, 22. The outlet valve in the container is operated by a button 23, which also has an orifice, 24, through which the medium from the container be dispensed. As also shown in FIGS. 3 and 4 the orifice, 24, can be extended through a tube or hose, 25.

When the actuator is applied on a container, it is pushed into the collar, 21, of the container, so that the protrusion, 22, of the collar of the container fits into the groove, 18, of the collar of the actuator as shown in FIG. 3. In this position, there is a distance between the button, 23, and the detent, 12, in the inside of the actuator and the container is not activated. When the actuator has been pushed further toward the container, as is shown in FIG. 4 the aforementioned ridge, 22, in the collar of the container fits into the upper groove 16 in the collar, 15, of the actuator. Sufficient resistance of this collar, 15, allows the middle ridge, 17, to slide through the surrounding ridge, 22, however, the resilient collar still has enough spring force so that its middle ridge, 17, prevents the actuator from sliding back up when affected only by the force from the spring-loaded valve via the button, 23, which simultaneously was pushed down by the detent, 12, of the actuator. The movements of the actuator are facilitated by the groove, 11, around the upper part of the actuator. For this purpose the groove could be replaced by a ridge or the outer surface of the actuator could be rough.

As easily can be understood by the description above, it is important that the material and the design of an actuator in accordance with this invention, are matched in the right way. This is especially significant for the collar, 15, of the actuator. The outer diameters of the ridges, 17, 19, and the grooves, 16, 18, are dependent not only on the dimensions of the surrounding collar, 15, and its ridge, 16, but also on the resiliency of the material of the actuator. When a prototype of the invention was designed and manufactured it was found that when using a slightly resilient plastic material, it was easy to determine appropriate dimensions for the grooves, 16, 18, and ridges, 17, 19, of the collar of the actuator and the wall thickness of this collar and the appropriate number of slots, 20, so that the prototype actuator could be successfully operated on an aerosol container as is described above. It was found that in order to safely keep the actuator in its upper, deactivated position and still be able to easily move it into the lower, activated, position, the lower ridge, 19, should have a slightly larger diameter than the middle ridge, 17.

Figure 5:
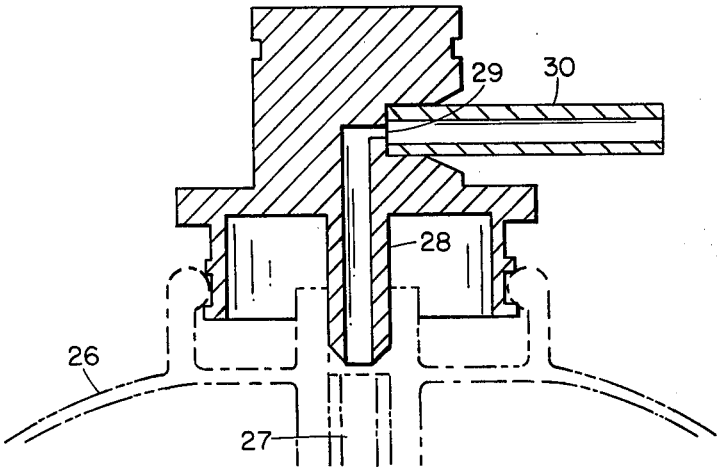
FIG. 5 also schematically shows the upper part of an aerosol container in order to illustrate how the actuator is applied on the container in the deactivated mode.
Figure 6:
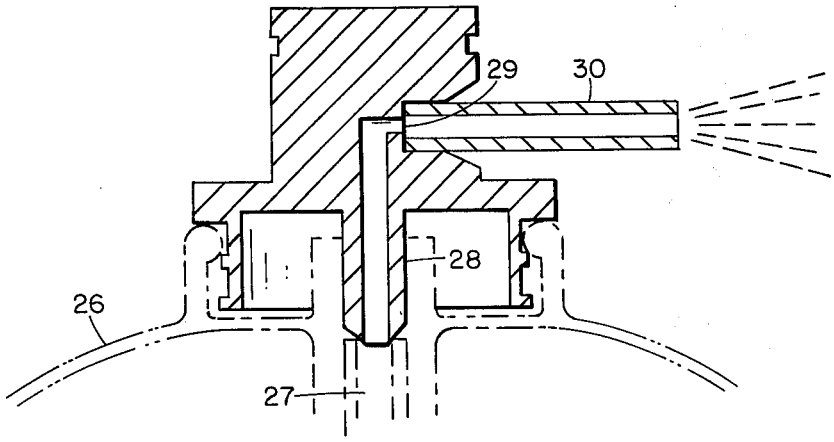
FIG. 6 shows, in the same way, the actuator in the activated mode.

The above described embodiment of the invention is suitable when it is desired that the container also be activated for very short periods of time which is conveniently done by removing the actuator and using the aerosol, container in the usual way. However, in many cases aerosol containers are used for different additives, for example an additive to a fuel to prevent icing of the carburetor. Then the additive usually is directed into the fuel flow during refueling and the flow of the additive starts and ends simultaneously with the fuel flow. For such cases an embodiment as shown in FIG. 5 will be the most expedient. This actuator has at its lower end the same kind of collar and is operated in the same way as described above. In FIG. 5, schematically shown is the upper part of an aerosol container, 26, with the actuator located in its upper deactivated position. The outlet from the aerosol container is the hollow stem, 27, of a spring loaded valve (not shown). The actuator has a tube, 28, which communicates with a metering orifice, 29, and another tube or hose, 30, through which the medium can be directed to the desired place. Between the hollow valve stem, 27, of the container and the tube, 28, of the actuator there is a space by which the spring loaded valve is allowed to seal against its seat. When the actuator is pushed down to its lower position, as is shown in FIG. 6, the activated mode, the wall of the tube is pressed tight against the wall of the hollow valve stem confining the flow in its channel when the spring loaded valve is opened by the downward moved tube.

The professional man in the field will easily understand that the invention can be designed in several different ways in order to meet the following main objectives: that the actuator can easily be engaged, that the actuator can easily be operated for activating or deactivating an aerosol container, and that the actuator will not accidentally fall off when a deactivated container is handled, for example during transportation.

The collar of the actuator can be designed in many different ways. For example, in the above described embodiment, the actuator has a collar, 15, which is divided into several parts by slots, 20, in order to give the collar enough resiliency so that the actuator can easily be moved from one position to the other. This objective can be met by having a relatively large number of slots, but can also be met by having a lesser number of slots and a lower middle ridge, 17, between the two grooves, 16, 18. Other factors of importance are the property of the material of which said collar is made and the thickness of the wall of the collar. An extreme example can be envisioned where the collar is defined as two or three legs with notches.

The invention has a further advantage. It can be provided with a separate ring which can be placed around the collar of the actuator and occupy the space between the flange of the actuator and the collar of the aerosol container. When the actuator with this ring is applied on an aerosol container, the ring prevents accidental activation of the container and the cap, commonly used for this purpose can be eliminated.

What is claimed is:

1. An acutator for an aerosol-type container having a spring loaded valve member, said container having an annular collar provided with an annular protruding portion, said actuator having a radially projecting flange portion from which depends an annular resilient collar, said collar being provided with parallel upper and lower annular grooves, said grooves being dimensioned to engage about and couple with said annular protruding portion, whereby when said annular protruding portion is engaged with the lower groove said container valve is maintained in an unactuated position and when said annular protruding potion is engaged with the upper groove said container valve is in and is restrained in an actuated position.

2. An actuator as defined in claim 6 having a collar, divided by one or more slots, where the number of slots and their dimensions are selected so that the collar, or the remaining parts of the collar, will be resilient enough to allow the actuator to be easily actuated or unactuated manually or so that, once engaged, it can easily be moved to or from either of its possible positions, but at the same time stiff enough to keep the actuator at set position, when it is not affected by an outside force other than the force from the spring loaded valve of the container.

3. An actuator as defined in claim 2 having the material and dimensions of the collar of the actuator selected so that a stronger force is needed for disengaging the actuator from the container than the force needed for moving the actuator from its upper to its lower engagement on the container or vice versa in order to prevent accidental fall off.

4. An actuator as defined in claim 3 intended for use on a container which has a spring loaded valve operated by a valve button, said actuator having an upper hollow part giving sufficient inside room for the valve button of said container and a roof with a detent located so that when the actuator is engaged to the container in its upper position, there is a space between said detent and the valve button of the container, said space being significantly smaller than the distance the actuator travels towards the container when it is moved from its upper to its lower position.

5. An actuator as defined in claim 3, intended for use on a container with an outlet formed by the end of a hollow stem of a spring loaded valve, said actuator having a channel and a tube said channel communicating at one end with an orifice and at the other end with said tube which has a position selected so that the tube is aligned with the hollow stem of the valve of the container having its open end parted from said hollow valve stem by a distance significantly shorter than the distance the actuator travels towards the container when it is moved from its unactuated position, where the valve of the container is closed, to its actuated position where the valve is opened by the aforementioned tube.

* * * * *

UNITED STATES PATENT AND TRADEMARK OFFICE

CERTIFICATE OF CORRECTION

PATENT NO. : 4,440,325

DATED : April 3, 1984

INVENTOR(S) : Martin B. Treuhaft and Knut L. Winquist

It is certified that error appears in the above-identified patent and that said Letters Patent are hereby corrected as shown below:

Column 4, line 16, "6" should be -- 1 --.

Signed and Sealed this

*Thirtieth* Day of *April 1985*

[SEAL]

*Attest:*

DONALD J. QUIGG

*Attesting Officer*

*Acting Commissioner of Patents and Trademarks*